US008836594B2

(12) United States Patent
Rothwell et al.

(10) Patent No.: US 8,836,594 B2
(45) Date of Patent: Sep. 16, 2014

(54) RECONFIGURABLE LEAKY WAVE ANTENNA

(75) Inventors: Edward J. Rothwell, Williamston, MI (US); Raoul Ouedraogo, Okemos, MI (US)

(73) Assignee: Board of Trustees of Michigan State University, East Lansing, MI (US)

( * ) Notice: Subject to any disclaimer, the term of this patent is extended or adjusted under 35 U.S.C. 154(b) by 705 days.

(21) Appl. No.: 13/042,978

(22) Filed: Mar. 8, 2011

(65) Prior Publication Data

US 2011/0248898 A1 Oct. 13, 2011

Related U.S. Application Data

(60) Provisional application No. 61/322,318, filed on Apr. 9, 2010.

(51) Int. Cl.

| | |
|---|---|
| ***H01Q 11/02*** | (2006.01) |
| ***H01Q 1/38*** | (2006.01) |
| ***H01Q 9/04*** | (2006.01) |
| ***H01Q 3/24*** | (2006.01) |

(52) U.S. Cl.

CPC ..... *H01Q 11/02* (2013.01); *H01Q 9/0442* (2013.01); *H01Q 3/247* (2013.01)

USPC ..... 343/731; 343/700 MS

(58) Field of Classification Search

CPC ..... H01Q 11/02; H01Q 3/247; H01Q 9/0442

USPC ..... 343/700 MS, 723, 749, 750, 752, 876, 343/731

See application file for complete search history.

(56) References Cited

U.S. PATENT DOCUMENTS

| | | | | |
|---|---|---|---|---|
| 7,071,888 | B2 | 7/2006 | Sievenpiper | |
| 7,109,928 | B1 | 9/2006 | Thiele et al. | |
| 2008/0088510 | A1 * | 4/2008 | Murata et al. | 343/700 MS |
| 2011/0175791 | A1 * | 7/2011 | Ozdemir et al. | 343/876 |

* cited by examiner

*Primary Examiner* — Robert Karacsony

(74) *Attorney, Agent, or Firm* — Harness, Dickey & Pierce, P.L.C.

(57) ABSTRACT

A leaky wave antenna system is set forth. The antenna comprises: a microstrip fabricated on a top surface of a substrate; a ground plane formed on a bottom surface of the substrate; and a plurality of impedance components, each impedance component having one terminal electrically coupled to a lengthwise edge of the microstrip abutting the top surface of the substrate. A switch is electrically connected between each one of the plurality of impedance components and the ground plane. A control module coupled to the plurality of switches operates to specify a direction of a main beam radiating from the microstrip by selectively connecting one or more of the plurality of impedance components to the ground plane.

19 Claims, 8 Drawing Sheets

RECONFIGURABLE LEAKY WAVE ANTENNA

CROSS-REFERENCE TO RELATED APPLICATIONS

This application claims the benefit of U.S. Provisional Application No. 61/322,318, filed on Apr. 9, 2010. The entire disclosure of the above application is incorporated herein by reference.

FIELD

The present disclosure relates generally to a leaky wave antenna.

BACKGROUND

A microstrip leaky wave antenna radiates energy from a microstrip line on top of a dielectric substrate. The principle of this antenna is that a wave guided by the microstrip will "leak" or produce a radiated field within a certain frequency range. The radiation is dominated by a main beam, the direction of which is determined by the phase constant of the propagating wave. Since the propagation constant is frequency dependent, as the operating frequency is changed, the direction of the main beam also changes. Thus, the direction of the main beam cannot be controlled after the initial design except by changing the frequency. Although this frequency scanning characteristic makes leaky-wave antennas attractive for certain applications, fixing the main beam at particular frequencies would allow for other applications of the antenna whereby its other attractive attributes could be exploited (e.g., ease of fabrication, conformability and reasonable cost).

Therefore, it is desirable to achieve a leaky wave antenna configurable dynamically to output one or more main beams at user selectable angles while maintaining a fixed frequency. This section provides background information related to the present disclosure which is not necessarily prior art.

SUMMARY

A leaky wave antenna system is set forth. The antenna comprises: a microstrip fabricated on a top surface of a substrate; a ground plane formed on a bottom surface of the substrate; and a plurality of impedance components, each impedance component having one terminal electrically coupled to a lengthwise edge of the microstrip abutting the top surface of the substrate. A switch is electrically connected between each one of the plurality of impedance components and the ground plane. A control module coupled to the plurality of switches operates to specify a direction of a main beam radiating from the microstrip by selectively connecting one or more of the plurality of impedance components to the ground plane.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

Figure 1:
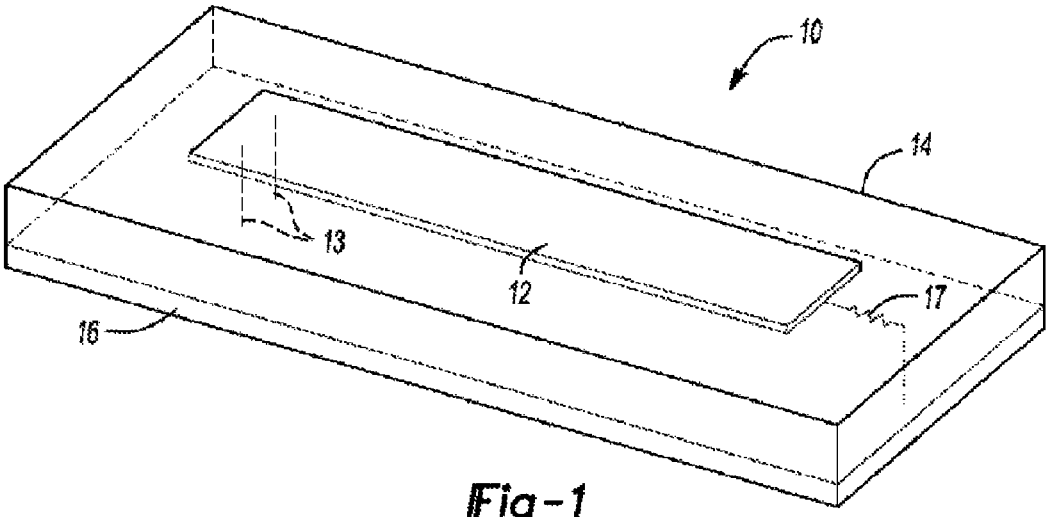
FIG. 1 is a perspective view of an exemplary leaky wave antenna.

The drawings described herein are for illustrative purposes only of selected embodiments and not all possible implementations, and are not intended to limit the scope of the present disclosure. Corresponding reference numerals indicate corresponding parts throughout the several views of the drawings.

DETAILED DESCRIPTION

FIG. 1 depicts an exemplary leaky wave antenna 10. The antenna generally comprises a microstrip 12 formed on a top surface of a dielectric substrate 14 and a ground plane 16 formed on the bottom surface of the substrate. The microstrip is a conductive material having a generally rectangular cuboid shape. The microstrip may be etched or otherwise fabricated onto the top surface of the substrate. It is envisioned that the microstrip 12 need not be straight nor the substrate 14 need not be planar. Other shapes for the microstrip and/or the substrate are contemplated by this disclosure. The antenna 10 also includes two feed pins 13 electrically coupled to the microstrip for inputting/outputting a signal into the antenna. Although this exemplary embodiment is depicted as a full-width antenna, it is readily understood that the concepts set forth herein are also applicable to half-width antennas.

Figure 2:
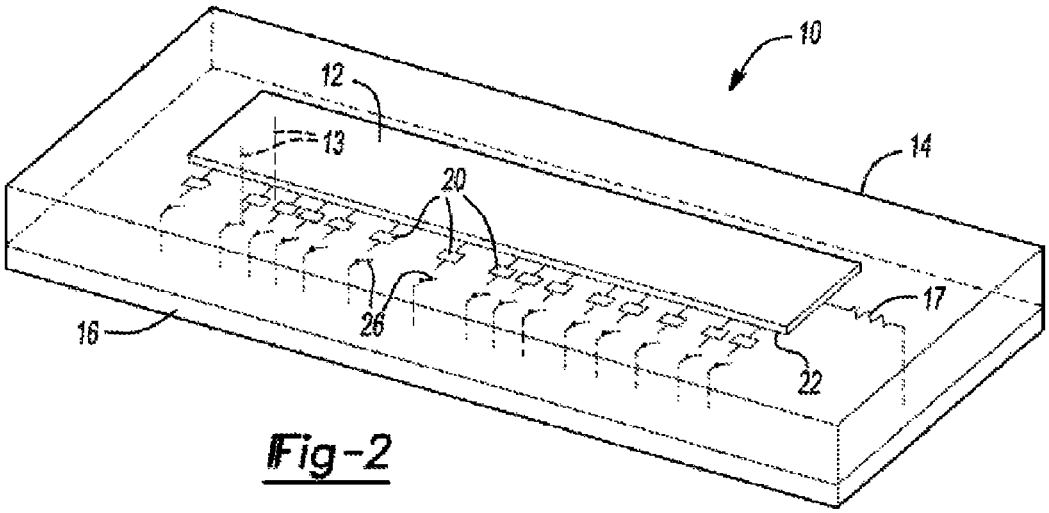
FIG. 2 is a perspective view of the leaky wave antenna having a plurality of impedance components electrically connected to an edge of the microstrip abutting the top surface of the substrate.
Figure 4:
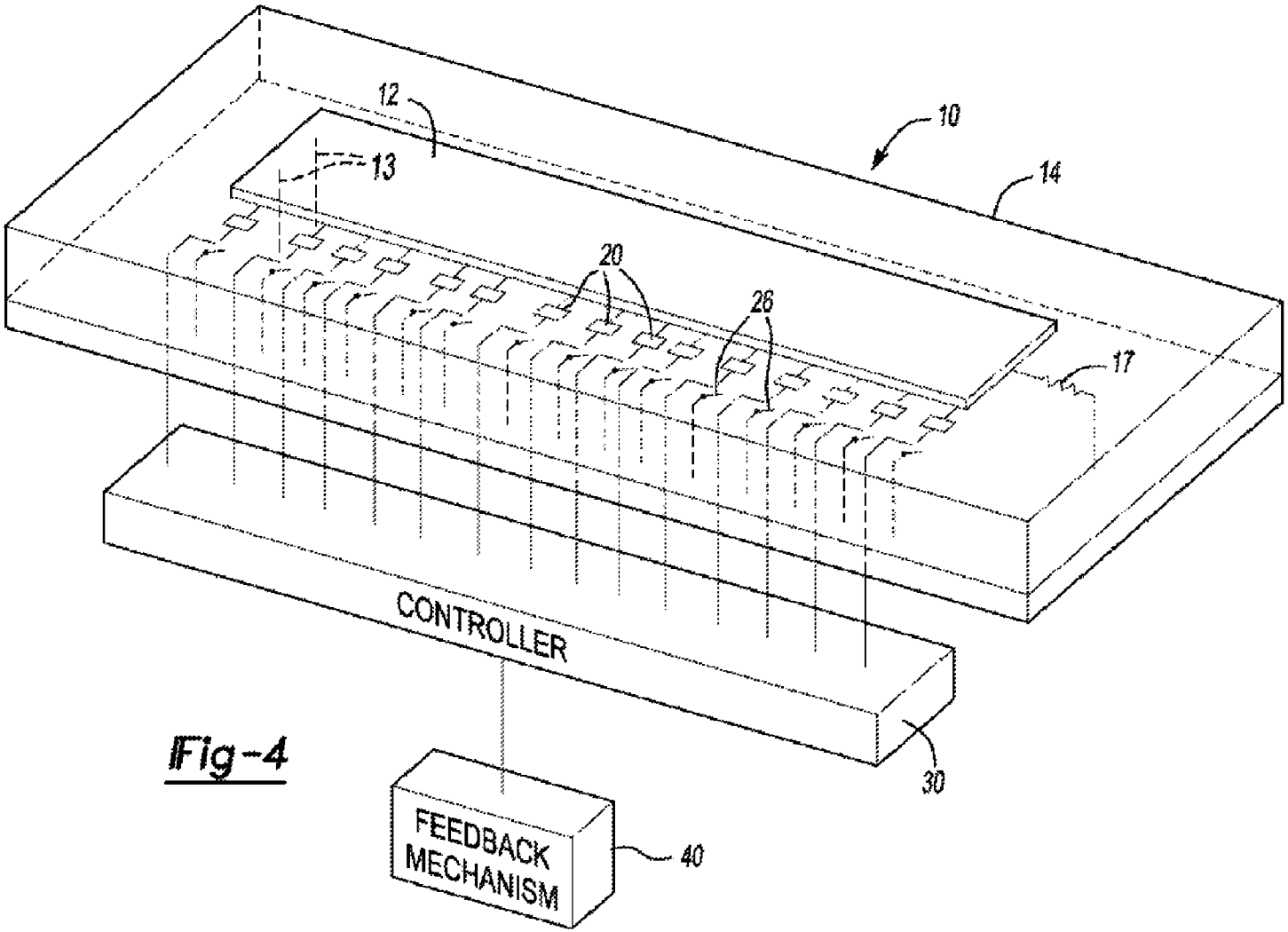
FIG. 4 is a perspective view of the leaky wave antenna system including a control module and feedback mechanism.

The antenna 10 is modified by coupling impedance components 20 to an edge 22 (also referred to as the open edge) of the microstrip 12 as shown in FIGS. 2 and 4. More specifically, the plurality of impedance components 20 are disposed on the top surface of the substrate and are electrically connected between a lengthwise edge of the microstrip 12 abutting the top surface of the substrate and the ground plane 16. The plurality of impedance components are positioned length wise along the microstrip preferably with irregular spacings therebetween. Irregular spacings between the impedance components increase the diversity of antenna states. Regular spacings between the impedance components are also contemplated.

In the exemplary embodiment, the impedance components are further defined as capacitors. Although capacitive components may prove easiest to implement in practice, the impedance components do not have to be purely capacitive. Rather, impedance components may be implemented as resistors, inductors, varactors or other types of impedance elements including non-Foster and other active elements such as transistors. Furthermore, it is envisioned that other structures that are not generally considered electronic components can also be used to provide the necessary impedance loading effect. Exemplary structures can include metallic patches or pads, interdigitated lines, spiral metallic traces, dielectric resonators or other dielectric structures as well as structures with magnetic or magnetoelectric properties. These other structures do not need to be directly coupled to the microstrip edge (although they might be) but would still be connected through a switch to ground. For instance, these other structures could be connected to the microstrip edge through a proximity effect such as electric or magnetic field coupling. It is also not necessary that any of these impedance components be identical to each other. In other exemplary embodiments, it is envisioned that different types of impedance components are coupled along the length of the microstrip.

The plurality of impedance components 20 are selectively coupled to the ground plane 16 by a plurality of switches 26. Each switch 26 is coupled between one of the impedance components and the ground plane. The operating states of each switch 26 (i.e., whether the switch is in an open or closed position) is controlled by a control module 30. To do so, the control module 30 is also coupled to each of the switches 26. A transistor or another type of switching element may be used to implement a switch 26. In the case of a transistor, the control module applies a control signal via a control line to a control terminal of the transistor, thereby controlling the operating state of the switch. As used herein the term module, controller and/or device refers to an application specific integrated circuit (ASIC), an electronic circuit, a processor (shared, dedicated, or group) or memory that execute one or more software or firmware programs, a combinational logic circuit, or other suitable components that provide the described functionality.

Figure 3:
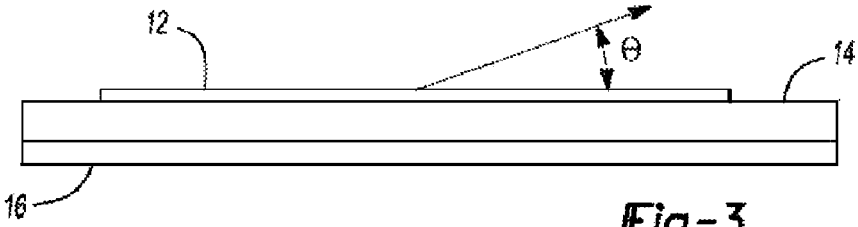
FIG. 3 is a side view of the leaky wave antenna.

The control module operates to specify a direction of the main beam radiating from the antenna. The direction of the main beam is determined by the distribution of the capacitance (or impedance) placed at the open edge of the microstrip. Changing the impedance changes the phase constant of the wave traveling along the microstrip and thus changes the angle of the main beam emitted from the microstrip. For example, a particular impedance is applied to the edge of the microstrip when all of the switches are placed in a closed state, thereby achieving a particular launch angle of the main beam. By changing the operating state of some or all of the switches, the impedance changes in a predictable manner as does the launch angle ($\theta$) of the main beam as best seen in FIG. 3. In this way, the control module can operate to set the direction of the main beam radiating from the antenna.

An antenna having N switches can be configured to produce $2^N$ different combinations of impedance profiles. The control module is further operable to select which switch states to implement. In one exemplary embodiment, switch configurations are predetermined for a plurality of desired launch angles and may be stored in a data stored associate with the control module 30. During operation, the control module 30 receives an input indicating a desired direction for the main beam. The control module 30 in turn retrieves the switch configuration from the data store that corresponds to the desired launch angle and reconfigures the plurality of switches in accordance with the retrieved switch configuration.

Figure 10:
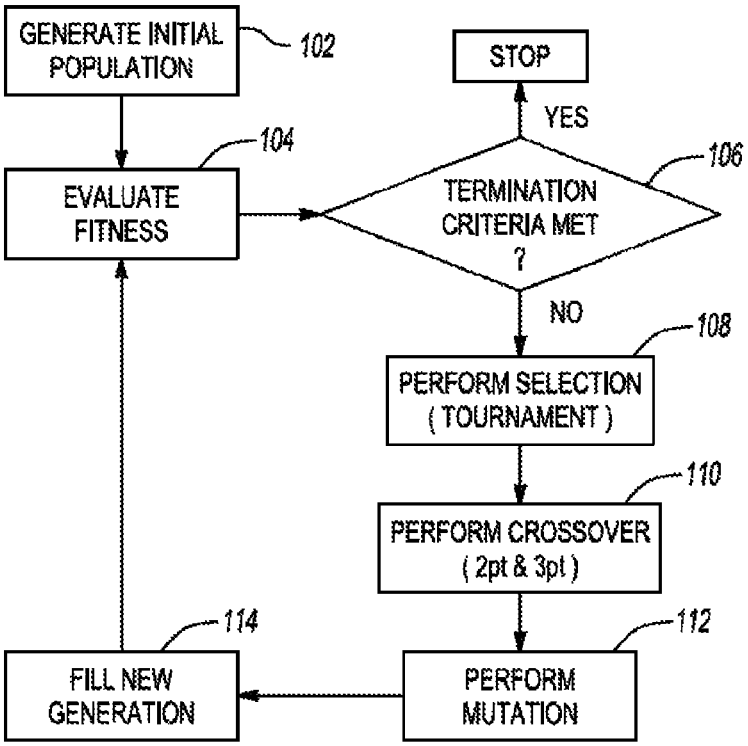
FIG. 10 is a flowchart depicting an exemplary genetic selection algorithm that may be used by the leaky wave antenna system.
Figure 11A:
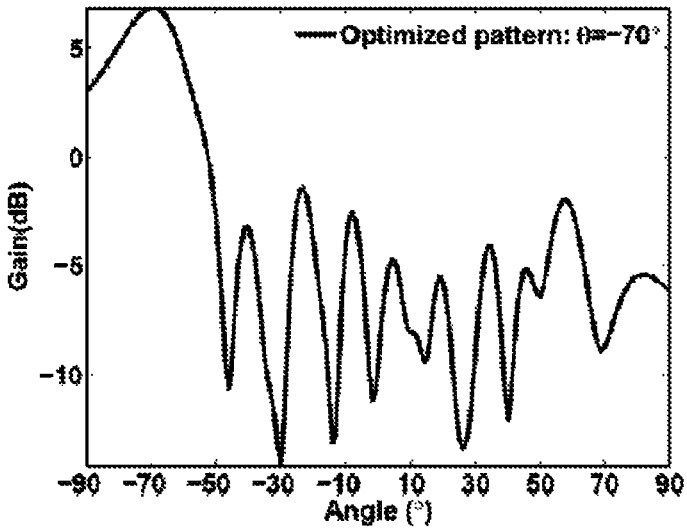
FIGS. 11A-11G are diagrams illustrating simulated radiation patterns for the leaky wave antenna optimized to have a main beam at various angles while maintaining a frequency fixed at 6 GHz.
Figure 11B:
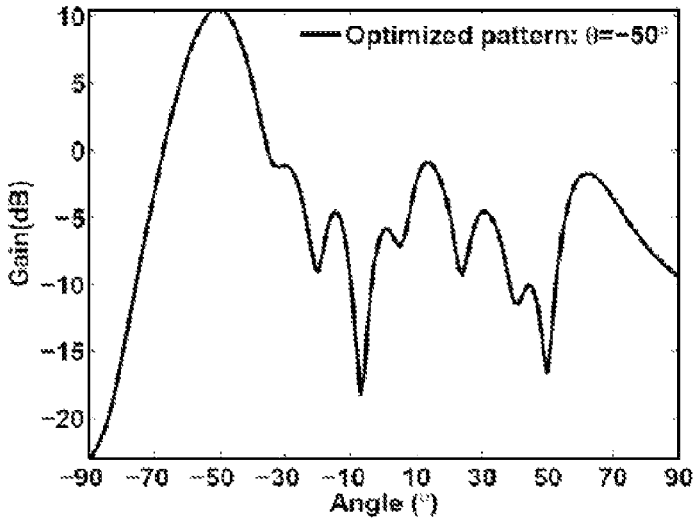
Figure 11C:
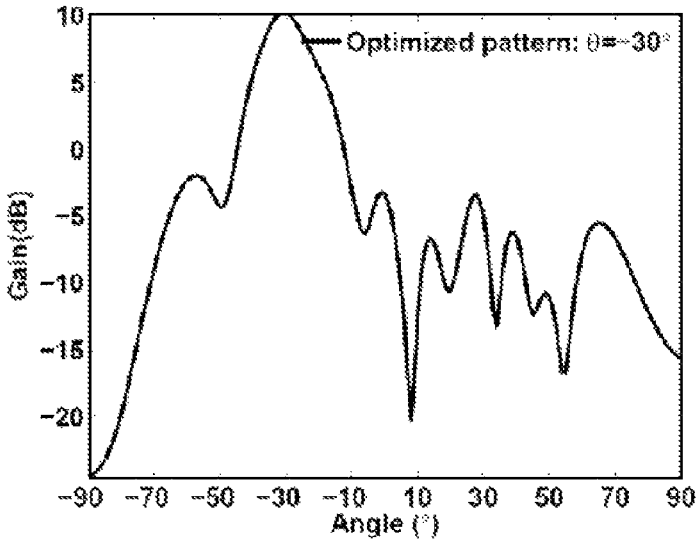
Figure 11D:
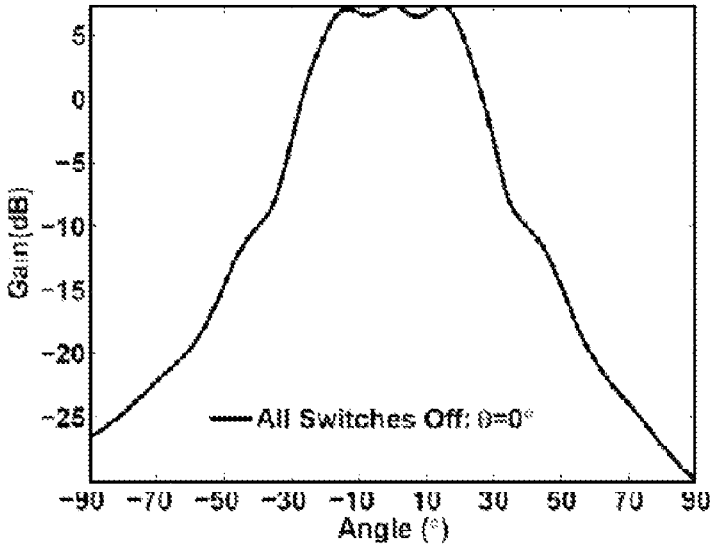
Figure 11E:
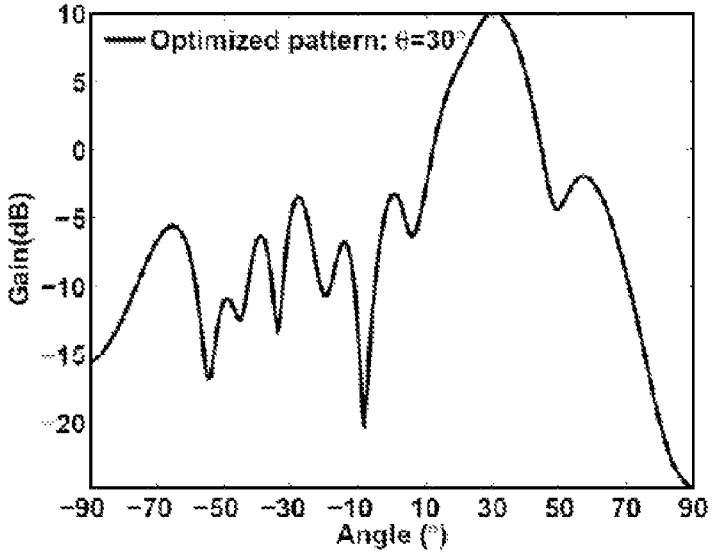
Figure 11F:
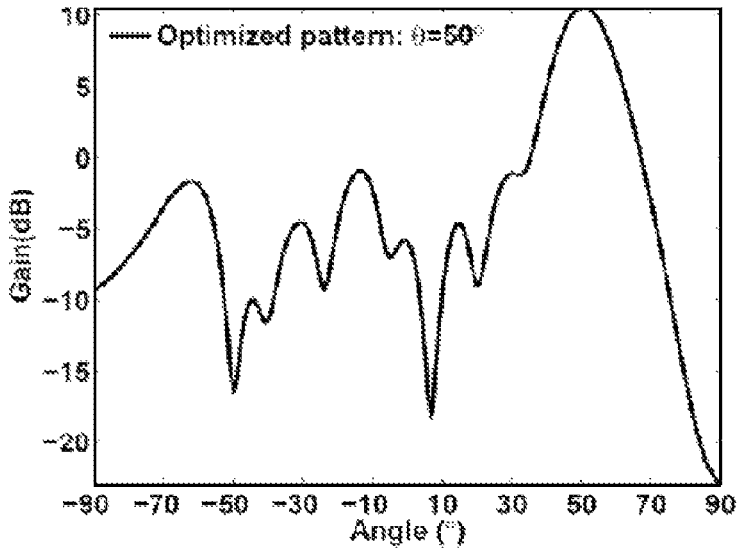
Figure 11G:
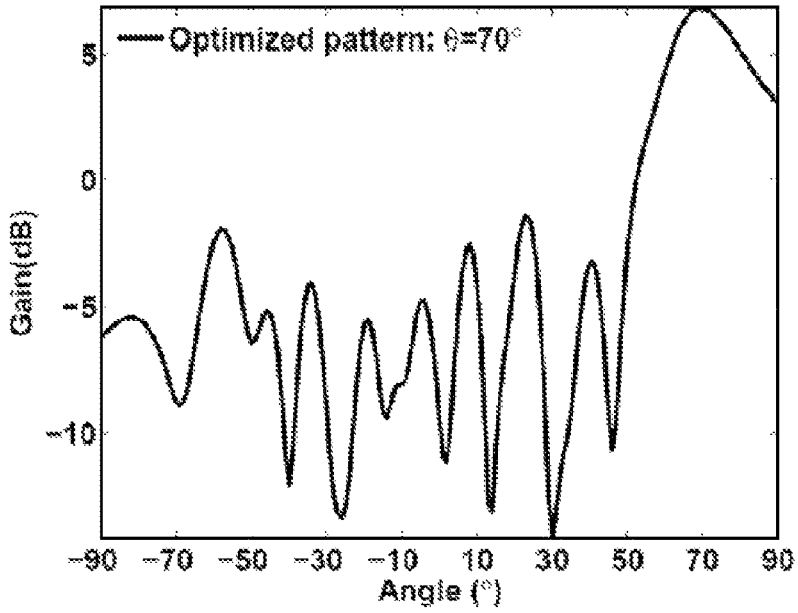

For a desired launch angle, the corresponding switch configuration may be derived using a genetic selection algorithm as described in relation to FIG. 10. For illustration purposes, an initial population of 160 switch configurations for the antenna is first selected randomly as indicated at 102. In the case on an antenna having 40 impedance components, each switch configuration is a 40 bit binary string. The goal is to derive a switch configuration that achieves the desired launch angle. Accordingly, fitness is evaluated at 104 using the equation: $\text{fit}=\max[G2(\theta)]-G1(\theta_o)$, where $\theta_o$ is the angle of interest, $G1(\theta_o)$ is the gain at the angle of interest. $G2(\theta)$ represents the set of gain values at angles outside a predefined range of angles. For instance, if the goal is to steer the main beam to −60° while minimizing the gain at any other angle that is at least 20° away from −60°, $G2(\theta)$ will be defined as the set containing the angles [−90, −80] and [−40, 90]. The genetic algorithm is set to minimize the fitness function defined above. Note from the definition of the fitness function that minimizing the fitness is equivalent to minimizing the maximum of $G2(\theta)$ while maximizing $G1(\theta_o)$.

For every switch configuration in the population, a simulation is performed using, e.g., the HFSS electromagnetic field simulation tool commercially available from Ansoft, Inc. The exported gain values are used to calculate the fitness of the corresponding switch configuration. When the termination criterion is not met, a tournament selection of the best 20% is performed at 108 to determine the mating parents. Crossover and mutation are performed at 110 and 112, respectively, on the selected parents till a new population of 80 switch configurations is generated. More specifically, the genetic algorithm may employ a combined 2-point and 3-point crossover with an evolving single bit mutation. Note that the population size is reduced to ½ after the first generation. Fitness is then calculated for the new generation. The process is repeated until the termination criteria are met, thereby yielding a suitable switch configuration. Other techniques for determining the switch configuration for a given launch angle are also within the scope of this disclosure.

Alternatively, the control module 30 may be configured to dynamically select the switch configuration to achieve the necessary launch angle to produce a desired result, such as maximum received signal. The control module 30 searches in real-time through different switch configurations to find an arrangement that achieves the desired result. The control module 30 may use a genetic algorithm or some other suitable selection method. A feedback mechanism 40 may be employed to facilitate the search process. The feedback mechanism 40 will measure some property associated with the operation of the antenna. The measured property is in turn used by the control module when selecting a switch configuration.

For example, when the antenna is operating in transmit mode, a secondary receive antenna may be used as the feedback mechanism to determine properties (e.g., launch angle) of the beam emitted from the leaky wave antenna 10. Alternatively, a current probe may be used to measure the current of traveling wave along the microstrip. When the antenna is operating in a receive mode, the signal strength (or bit error rate) of the received signal can be measured. In this arrangement, the control module modifies the switch configuration to maximize the signal strength. Other types of feedback mechanisms may be interfaced with the control module and are contemplated by this disclosure.

Leaky wave antennas produce radiation in the direction of the wave traveling along the microstrip as noted above. This radiation must be absorbed at the end of the microstrip or the wave will be reflected, thereby creating an undesirable backlobe. By choosing an appropriate switch configuration that improves the match between the loaded transmission line and a terminating impedance 17, or by choosing an appropriate configuration that results in a small wave amplitude at the terminating impedance, the backlobe can be suppressed. In other words, the control module 30 can select an impedance profile to minimize the backlobe. For example, the control module 30 may select an arrangement where impedance toward the end of the transmission line includes a resistive component (and possibly a reactive component) which absorbs the forward propagating wave. By switching among different impedance components, reflection could be reduced while still maintaining direction of the main beam. Furthermore, if the reflected signal could be reduced by increasing the attenuation constant of the forward propagating wave rather than absorbing it at a terminating load, then the efficiency of the antenna could be improved.

Likewise, choosing an appropriate impedance profile can improve the match between the feed cable and the microstrip of the antenna. In this case, positioning both inductive and capacitive impedances near the feed pin allow the impedance matching to be optimized. Thus, the impedance components can be selected and configured in a manner that enables the control module to select an impedance profile that improves input matching, backlobe suppression or both.

Figure 7:
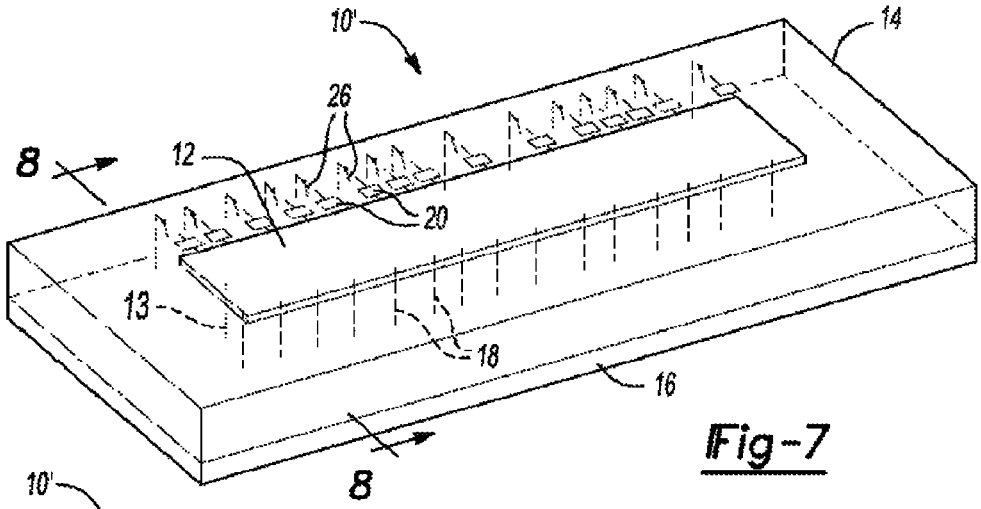
FIG. 7 is a perspective view of the leaky wave antenna having an optionally perfect electric conducting septum that connects the microstrip to the ground plane 14.
Figure 8:
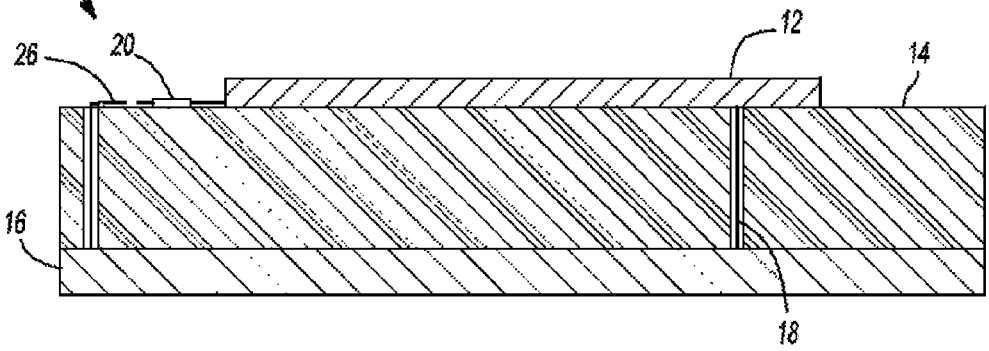
FIG. 8 is a cross-sectional view of the leaky wave antenna.

With reference to FIGS. 7 and 8, the antenna 10' may optionally include a perfect electric conducting septum 18 that connects the microstrip 12 to the ground plane 14. In an exemplary embodiment, the septum is fabricated using a plurality of shorting pins that electrically couple the microstrip 12 to the ground plane 14. Other techniques for shorting the microstrip to the ground plane are contemplated by this disclosure. The septum 18 provides an effective mechanism for suppressing fundamental mode propagation in the antenna. Further details regarding the septum may be found in U.S. Pat. No. 7,109,928 which is incorporated herein by reference. This disclosure also contemplates other techniques for suppressing fundamental mode propagation, such as placing slots in the microstrip.

Fundamental concepts set forth above have been verified using simulations. An exemplary geometry for the leaky wave antenna is as follows. The microstrip was sized to be 7.5 mm in width and 200 mm in length. The microstrip was backed by a substrate sized to be 215 mm in length, 82.5 mm in width and 0.7874 mm in thickness. The substrate exhibited a dielectric constant of 2.33 and a loss tangent of 0.0012. Fifty capacitors having a capacitance of 0.1 pF were coupled along the open edge of the microstrip and selectively connected to the ground plane using controllable switches. The design and optimization of the leaky wave antenna was performed using an integration of an optimization tool (e.g., genetic algorithm) written in Matlab and a full wave solver tool, such as the HFSS electromagnetic field simulation tool commercially available from Ansoft, Inc HFSS. The geometries of the leaky wave antenna and switches are generated in Matlab and exported to HFSS for simulation.

Figure 5:
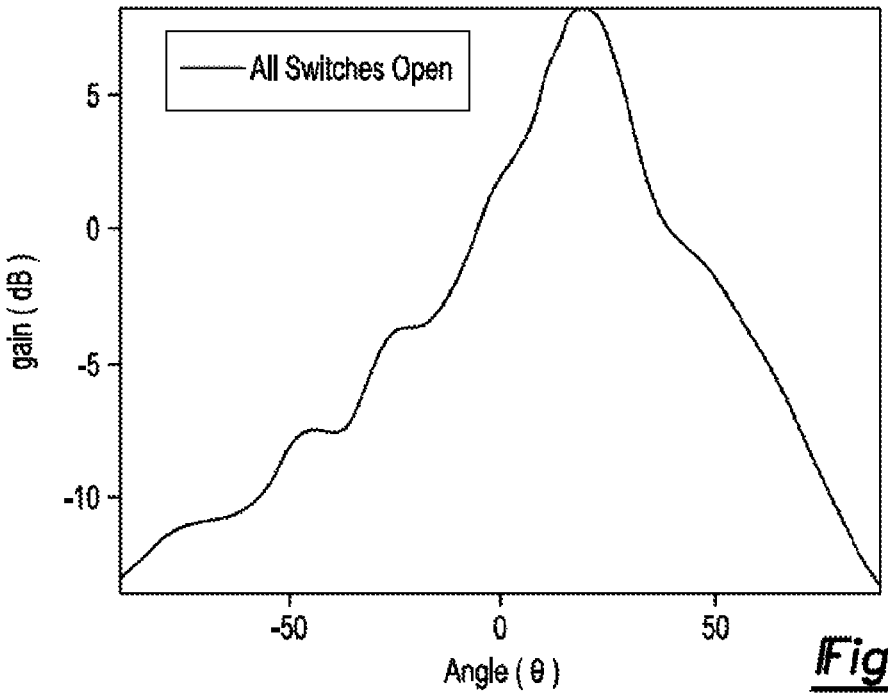
FIG. 5 is a diagram illustrating the simulated radiation pattern from the antenna at 6 GHz with all of the switches placed in an open position.
Figure 6:
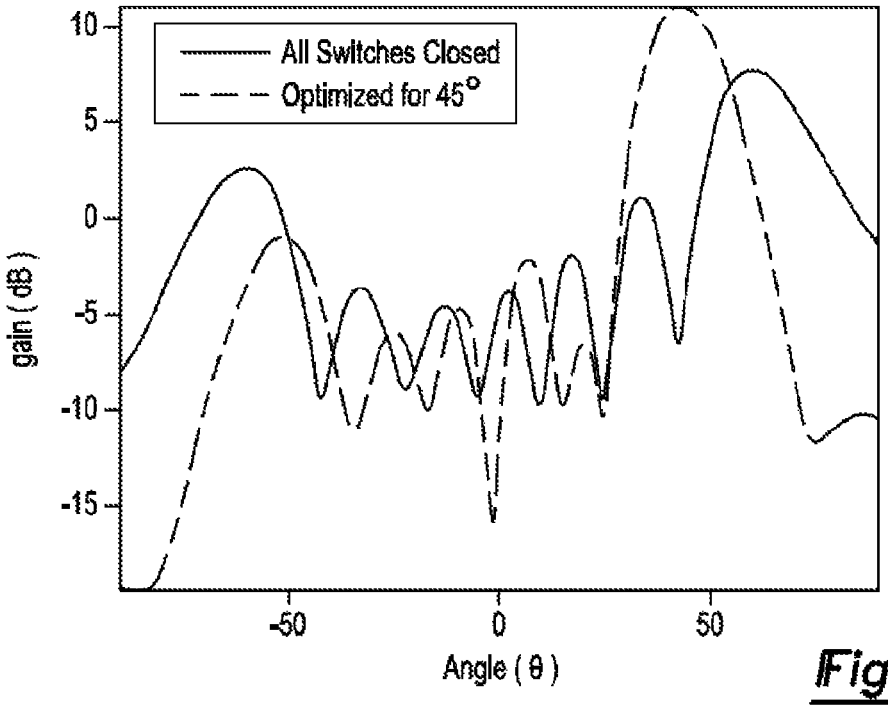
FIG. 6 is a diagram illustrating the simulated radiation pattern from the antenna when all of the switches are placed in a closed position and for an optimized configuration.

FIG. 5 illustrates the simulated radiation pattern at 6 GHz utilizing the half-width antenna discussed in relation to FIG. 7. The antenna is configured with all of the switches placed in an open position. In other words, none of the impedance components are coupled to the ground plane. For this impedance arrangement, the launch angle is 20 degrees. In comparison, FIG. 6 illustrates the simulated radiation pattern from the same antenna when all of the switches are placed in a closed position (i.e., uniform loading). In this case, the launch angle of the main beam is about 60 degrees. It is also noted that the backlobe has a gain of about 3 dB.

The impedance arrangement was further modified to achieve a launch angle of 45 degrees. More specifically, a genetic algorithm was used to select a switch arrangement that maximizes the strength of the main beam at 45 degrees. The resulting switch arrangement was found in four generations using a population of sixty. Eighteen of the fifty switches were closed in the resulting switch arrangement and the launch angle of the main beam occurred at about 45 degrees. Gain of the main beam was increased from around 8 dB to over 10 dB. The backlobe was also suppressed from 3 dB to −2 dB using the selected impedance arrangement. During the selection process, several impedance arrangements were found with main beams positioned at 45 degrees but having different beam widths and efficiencies. These results give credence to enhancing gain and efficiency of the antenna while at the same time setting the desired launch angle. While the exemplary embodiment shown in FIG. 7 has been shown to work and is presently preferred, further research may indicate that better results may be achieved using the other embodiments described herein.

Figure 9:
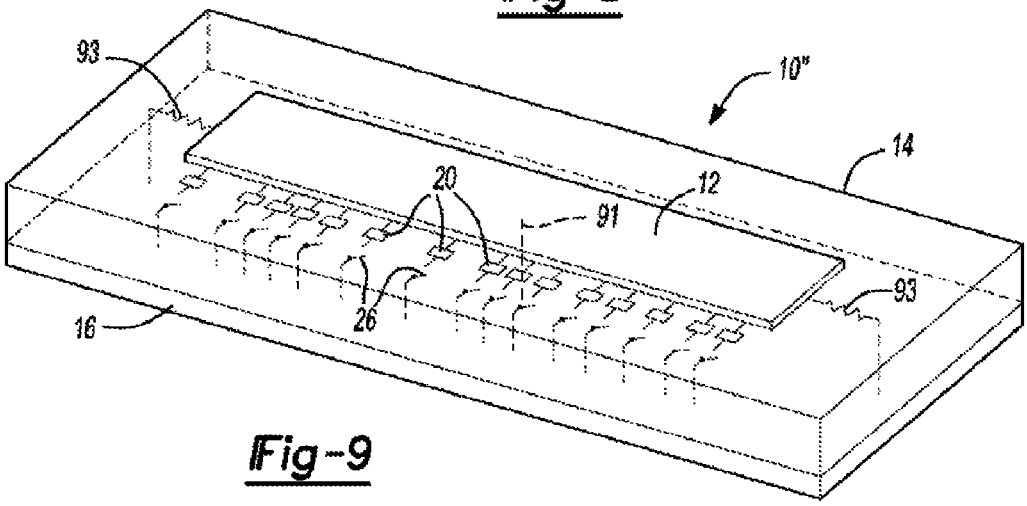
FIG. 9 is a perspective view of another exemplary embodiment of a leaky wave antenna.

FIG. 9 depicts another exemplary embodiment of a leaky wave antenna 10". In this embodiment, the feed pin 91 is centered along the long dimension of the microstrip as shown in the figure. A terminating load 93 is placed at each end of the microstrip. Remaining antenna components are as described above in relation to the embodiments above.

This leaky wave antenna 10" was modeled and simulated as a proof of concept. The microstrip of the antenna was sized to be 40 cm long and 0.75 cm wide. The microstrip was backed by a substrate having thickness 0.7874 mm, width 13.5 cm and length 53.5 cm. The substrate has a dielectric constant $\in_r$=2.33 and dielectric loss tangent $\delta$=0.0012. The substrate was backed by an infinitely large, perfectly conducting ground plane set with infinite boundary conditions. One side of the strip line is shorted to the ground plane using a septum while 40 equally spaced 0.2 pf capacitors are connected to the opposite side of the strip. For simplicity of the design, the switches placed between the opposite end of the capacitors and the ground plane are modeled as connecting wires of radius 0.1905 mm and height 0.7874 mm. Through this model, a switch is turned on by placing a connecting wire between a capacitor and the ground plane. A switch off means that there is no connection between the capacitor and the ground plane (remove connecting wire). A 50Ω coaxial feed is placed 4.555 mm away from the septum and centered along the long dimension of the strip as shown in FIG. 9. Two 50Ω terminating loads 93 are placed at the ends of the microstrip line (one on each side) and 4.555 mm away from the septum.

FIGS. 11A-11G illustrate plots of the gain of the leaky wave antenna shown in FIG. 9 optimized to have a main beam at various angles while maintaining a frequency fixed at 6 GHz. Changing impedance likewise changes the angle of the main beam emitted from the microstrip. Of note, the launch angle can be set or scanned through a 180 degrees range. For example, the launch angle can be optimized from −70 degrees in FIG. 11A to 70 degrees in FIG. 11G. Other exemplary launch angles are also shown in the figures. In this way, the main beam can radiate in both directions from the antenna.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A leaky wave antenna system, comprising:

a microstrip formed on a top surface of a substrate and defining a transmission line for a propagating wave along a first dimension of the microstrip, where the first dimension is longer than remaining dimensions of the microstrip;

a ground plane formed on a bottom surface of the substrate;

a plurality of impedance components disposed on the substrate and electrically connected via an electrode to a lengthwise edge of the microstrip abutting the top surface of the substrate;

a plurality of switches electrically connected between the plurality of impedance components and the ground plane; and a control module in communication with the plurality of switches to selectively connect one or more of the plurality of impedance components to the ground plane.

2. The leaky wave antenna system of claim 1 wherein the plurality of impedance components are further defined as capacitors.

3. The leaky wave antenna system of claim 1 wherein the plurality of impedance components are electrically coupled to a lengthwise edge of the microstrip with an irregular spacing therebetween.

4. The leaky wave antenna system of claim 3 further comprises a plurality of shorting pins disposed in the substrate and electrically coupled between the microstrip and the ground plane, where the shorting pins are coupled along an edge of the microstrip opposite the lengthwise edge and abutting the top surface of the substrate.

5. The leaky wave antenna system of claim 4 further comprises a feed pin electrically coupled to one end of the microstrip and configured to receive an input signal having a given frequency.

6. The leaky wave antenna system of claim 1 wherein the control module is adapted to receive an input for a desired direction for the main beam and operable to reconfigure the plurality of switches such that the main beam is radiated from the microstrip at the desired direction.

7. The leaky wave antenna system of claim 6 wherein the control module uses a genetic algorithm to select a switch configuration to achieve the desired direction of the main beam.

8. The leaky wave antenna system of claim 1 wherein the control module selectively controls the plurality of switches to steer the direction of the main beam over a range of beam directions while maintaining a fixed frequency of a signal input to the antenna.

9. The leaky wave antenna system of claim 1 further comprises a feedback mechanism in data communication with the control module and operable to measure an operating parameter of the antenna, wherein the control module selectively controls the plurality of switches based in part on input from the feedback mechanism.

10. A leaky wave antenna system, comprising:

a substrate;

a microstrip fabricated on a top surface of the substrate;

a ground plane formed on a bottom surface of the substrate;

a plurality of impedance components, each impedance component having one terminal electrically coupled to a lengthwise edge of the microstrip abutting the top surface of the substrate;

a plurality of switches, each switch electrically connected between one of the plurality of impedance components and the ground plane; and a control module operably coupled to the plurality of switches and operable to specify a direction of a main beam radiating from the microstrip by selectively connecting one or more of the plurality of impedance components to the ground plane.

11. The leaky wave antenna system of claim 10 wherein the plurality of impedance components are selected from a group consisting of resistors, capacitors, and inductors.

12. The leaky wave antenna system of claim 10 wherein the plurality of impedance components have an irregular spacing along the lengthwise edge of the microstrip.

13. The leaky wave antenna system of claim 10 further comprises two feed pins electrically coupled to one end of the microstrip and configured to receive an input signal having a given frequency.

14. The leaky wave antenna system of claim 10 further comprises a plurality of shorting pins disposed in the substrate and electrically coupled between the microstrip and the ground plane, where the plurality of shorting pins are coupled along an edge of the microstrip opposite the lengthwise edge and abutting the top surface of the substrate.

15. The leaky wave antenna system of claim 14 further comprises a feed pin electrically coupled to one end of the microstrip and configured to receive an input signal having a given frequency.

16. The leaky wave antenna system of claim 10 wherein the control module selectively controls the plurality of switches to specify the direction of the main beam and employs a genetic algorithm to select a switch configuration for the plurality of switches, where the genetic algorithm uses a fitness function as follows:

$$\text{fitness}=\max[G2(\theta)]-G1(\theta_o),$$

where $\theta_o$ is a desired angle for the main beam measured between the main beam and the microstrip, $G1(\theta_o)$ is the gain at the angle of interest, and $G2(\theta)$ represents the set of gain values at angles outside a predefined range of angles.

17. The leaky wave antenna system of claim 1 wherein the control module selectively controls the plurality of switches to steer the direction of the main beam over a range of beam directions while maintaining a fixed frequency of a signal input to the antenna.

18. The leaky wave antenna system of claim 1 further comprises a feedback mechanism in data communication with the control module and operable to measure an operating parameter of the antenna, wherein the control module selectively controls the plurality of switches based in part on input from the feedback mechanism.

19. A leaky wave antenna system, comprising:

a microstrip formed on a top surface of a substrate;

a ground plane formed on a bottom surface of the substrate;

a plurality of capacitors disposed on the substrate, each capacitor electrically connected to an edge of the microstrip abutting the top surface of the substrate;

a plurality of switches electrically connected between the plurality of impedance components and the ground plane; and a control module in communication with the plurality of switches to selectively connect one or more of the plurality of impedance components to the ground plane.

* * * * *